US005532718A

United States Patent [19]

Ishimaru

[11] Patent Number: 5,532,718

[45] Date of Patent: Jul. 2, 1996

[54] SEMICONDUCTOR INTEGRATED CIRCUIT DEVICE

[75] Inventor: Yoshiyuki Ishimaru, Itami, Japan

[73] Assignee: Mitsubishi Denki Kabushiki Kaisha, Tokyo, Japan

[21] Appl. No.: 422,661

[22] Filed: Apr. 14, 1995

Related U.S. Application Data

[63] Continuation of Ser. No. 205,223, Mar. 3, 1994, abandoned.

[30] Foreign Application Priority Data

Mar. 3, 1993 [JP] Japan ..... 5-42553

[51] Int. Cl.[6] ..... G09G 5/00

[52] U.S. Cl. ..... 345/211; 345/205; 345/89

[58] Field of Search ..... 345/98, 99, 100, 345/94, 95, 97, 88, 87, 89, 211, 205, 204, 210

[56] References Cited

U.S. PATENT DOCUMENTS

| | | | |
|---|---|---|---|
| 4,742,346 | 5/1988 | Gillette et al. | 345/89 |
| 5,027,036 | 6/1991 | Ikarashi et al. | 345/211 |
| 5,162,786 | 11/1992 | Fukuda | 345/100 |
| 5,170,155 | 12/1992 | Plus et al. | 345/100 |
| 5,343,221 | 8/1994 | Arakawa et al. | 345/211 |

OTHER PUBLICATIONS

Donald L. Schilling, "Electronic Circuits Discrete and Integrated", 1979, McGraw–Hill, Inc. pp. 708–711.

*Primary Examiner*—Richard Hjerpe
*Assistant Examiner*—Xiao M. Wu
*Attorney, Agent, or Firm*—Lowe, Price, LeBlanc & Becker

[57] ABSTRACT

A semiconductor integrated circuit device comprises a reference voltage generating circuit for transforming a power-supply voltage at multiple levels on the basis of a voltage specifying signal outputted from a CPU, a driving voltage generating circuit to which a reference voltage generated from the reference voltage generating circuit is given, and a liquid-crystal display control circuit for outputting a driving signal for driving a liquid-crystal display panel when the voltage generated from the driving voltage generating circuit is given. Since the device of the present invention can perform the contrast control based on the above voltage specifying signal, it becomes unnecessary to provide an additional contrast control circuit outside the device, unlike the conventional device. Moreover, with the constitution which enables an output voltage of the above reference voltage generating circuit to be provided to the outside, the device of the present invention becomes more versatile with respect to various products.

32 Claims, 15 Drawing Sheets

SEMICONDUCTOR INTEGRATED CIRCUIT DEVICE

This application is a continuation of application Ser. No. 08/205,223 filed Mar. 3, 1994, now abandoned.

BACKGROUND OF THE INVENTION

1. Field of the Invention

The present invention relates to a semiconductor integrated circuit device provided with a circuit for controlling the contrast of a liquid-crystal display panel.

2. Description of Related Art

FIG. 1 is a circuit block diagram of the main portion of a conventional semiconductor integrated circuit device, showing the constitution of a single-chip microcomputer in which provided with a CPU, ROM, RAM, and other peripheral circuits are built. In the drawing, numeral 1 designates a semiconductor chip held in a package 2. In the semiconductor chip 1 are installed the following circuits: the CPU 3; a memory 4 consisting of such built-in memories as the ROM and RAM; a port 5 for inputting or outputting digital signals such as an input signal, which is inputted via, e.g., a keyboard, or an output signal to a calculating circuit; an LCD control circuit 9 for outputting an LCD driving signal so that it is given to an LCD panel (see FIG. 2); an LCD driving voltage generating circuit 7 for generating a driving voltage so as to drive the LCD control circuit 9; and a COM/SEG output circuit 11 for outputting the LCD driving signal to the outside. A clock generating circuit 6 generates clock signals CLK which are given to the CPU 3, memory 4, port 5, and LCD control circuit 9. The CPU 3, memory 4, port 5, and LCD control circuit 9 are connected to each other via an address bus 12 and data bus 13. The CPU 3 provides control signals 14, such as a read signal and write signal, to the memory 4, port 5, and LCD control circuit 9.

The LCD control circuit 9 is driven by the driving voltage generated by the LCD driving voltage generating circuit 7. Upon receiving the driving voltage, the LCD control circuit 9 outputs the LCD driving signal to the COM/SEG output circuit 11. The LCD driving voltage generating circuit 7 in FIG. 1 shows an example of a 1/5 biased operation, in which five resistances 8 having the same value of resistance R are connected in series between a reference potential $V_{LCD}$ for the LCD and the ground potential so as to generate six different driving voltages $VL_0$ to $VL_5$. The above reference potential $V_{LCD}$ is supplied from outside of the semiconductor chip 1 via a lead frame 17 attached to the package 2, wire 18 composed of a gold wire or the like, and pad 16 provided around the semiconductor chip 1. Output signals from the semiconductor chip 1 to the outside, including the LCD driving signal outputted from the COM/SEG output circuit 11, and input signals from the outside to the semiconductor chip 1 are all transmitted via terminals in the lead frames 17, wire 18, and pad 16, similarly to the reference potential $V_{LCD}$.

FIG. 2 is a schematic diagram showing an example of the connection between the semiconductor integrated circuit device shown in FIG. 1 and the outside thereof. Among the large number of terminals in the lead frames 17, several are connected to the LCD panel 19 via a COM terminal 20 or SEG terminal 21, while others are connected to the power supply $V_{CC}$ directly or via a variable resistor 23. There is also another terminal in the lead frame 17 which is connected to the ground potential. To terminals in the lead frames 17 other than the ones mentioned above are inputted signals such as a reset signal and reference clock signal, but the description thereof will be omitted here.

Explanation will now be given to the controlling of the contrast of the LCD panel 19 by means of the semiconductor integrated circuit device thus constituted. The contrast of the LCD panel 19 changes in accordance with the voltage level of the LCD driving signal, i.e., with the reference potential $V_{LCD}$ for the LCD. When the voltage value is high, the contrast is also high. Conversely, when the voltage value is low, tile contrast is also low. To control the contrast of the LCD panel 19, therefore, it is necessary to change the reference potential $V_{LCD}$. In the constitution shown in FIG. 2, for example, it is possible to change the reference potential $V_{LCD}$ by using the variable resistor 23.

With the conventional device thus constituted, it is necessary to provide a reference voltage control device, such as the variable resistor 23, outside the semiconductor integrated circuit device (single-chip microcomputer). This not only causes an increase in number of the parts required to fabricate a product to which the semiconductor integrated circuit device is attached, thereby increasing cost, but also is disadvantageous in terms of saving space.

On the other hand, to expand the range of applications for the semiconductor integrated circuit device, it is required to be versatile, for some products have no outside space sufficient for the provision of such a reference voltage control device as mentioned above, while other products have a sufficient space for the provision of the reference voltage control device. In the case where the number of the COM terminals 20 and SEG terminals of the LCD panel 19 is so large that it is difficult to control the LCD panel 19 by means of a single semiconductor integrated circuit device and it is necessary to use plural semiconductor integrated circuit devices, it is desirable to apply the same reference voltage to all the control circuits being used. Hence, there has been a demand for a versatile semiconductor integrated circuit device which is applicable to these various products.

SUMMARY OF THE INVENTION

The present invention has been achieved in order to solve the above problems. An object of the present invention is to provide a semiconductor integrated circuit device which can control the contrast of the liquid-crystal display panel without providing an external control circuit device.

In the semiconductor integrated circuit device according to the present invention, the reference voltage to be inputted to the driving voltage generating circuit is generated in the reference voltage generating circuit by changing the value of the power-supply voltage on the basis of a voltage specifying signal given by the CPU. Consequently, it becomes possible to change the reference voltage in the semiconductor integrated circuit device, so that the outside space for the provision of the circuit is not required.

Another object of the present invention is to provide a semiconductor integrated circuit device which is sufficiently versatile so as to be applied to a variety of products.

The semiconductor integrated circuit device according to the present invention comprises means for outputting to the outside an output of the above reference voltage generating circuit. Consequently, the output of the reference voltage generating circuit can be used for external circuits as well as the internal circuits of the device.

The semiconductor integrated circuit device according to the present invention is constituted so that the output side of the above reference voltage generating circuit can be in the state of high impedance. Consequently, in the case where the reference voltage supplied from outside the device is used to operate the driving voltage generating circuit, the driving voltage generating circuit is not affected by the output voltage of the reference voltage generating circuit.

The semiconductor integrated circuit device according to the present invention is also constituted so that the input side of the above driving voltage generating circuit can be in the state of high impedance. Consequently, in case of outputting the output voltage of the reference voltage generating circuit to the outside, the output voltage is not affected by the variation in impedance on the input side of the driving voltage generating circuit.

Still another object of the present invention is to provide a semiconductor integrated circuit device which enables the automatic control of the contrast of a liquid-crystal display panel.

The semiconductor integrated circuit device according to the present invention comprises an A/D converting circuit for converting an analog voltage value, which is inputted from the outside and varies in response to the ambient temperature, to a digital value for determining the above voltage specifying signal.

The above and further objects and features of the invention will more fully be apparent from the following detailed description with accompanying drawings.

DESCRIPTION OF THE PREFERRED EMBODIMENTS

Example 1

In the following, the present invention will be described with reference to the drawings showing the embodiments thereof.

Figure 1:
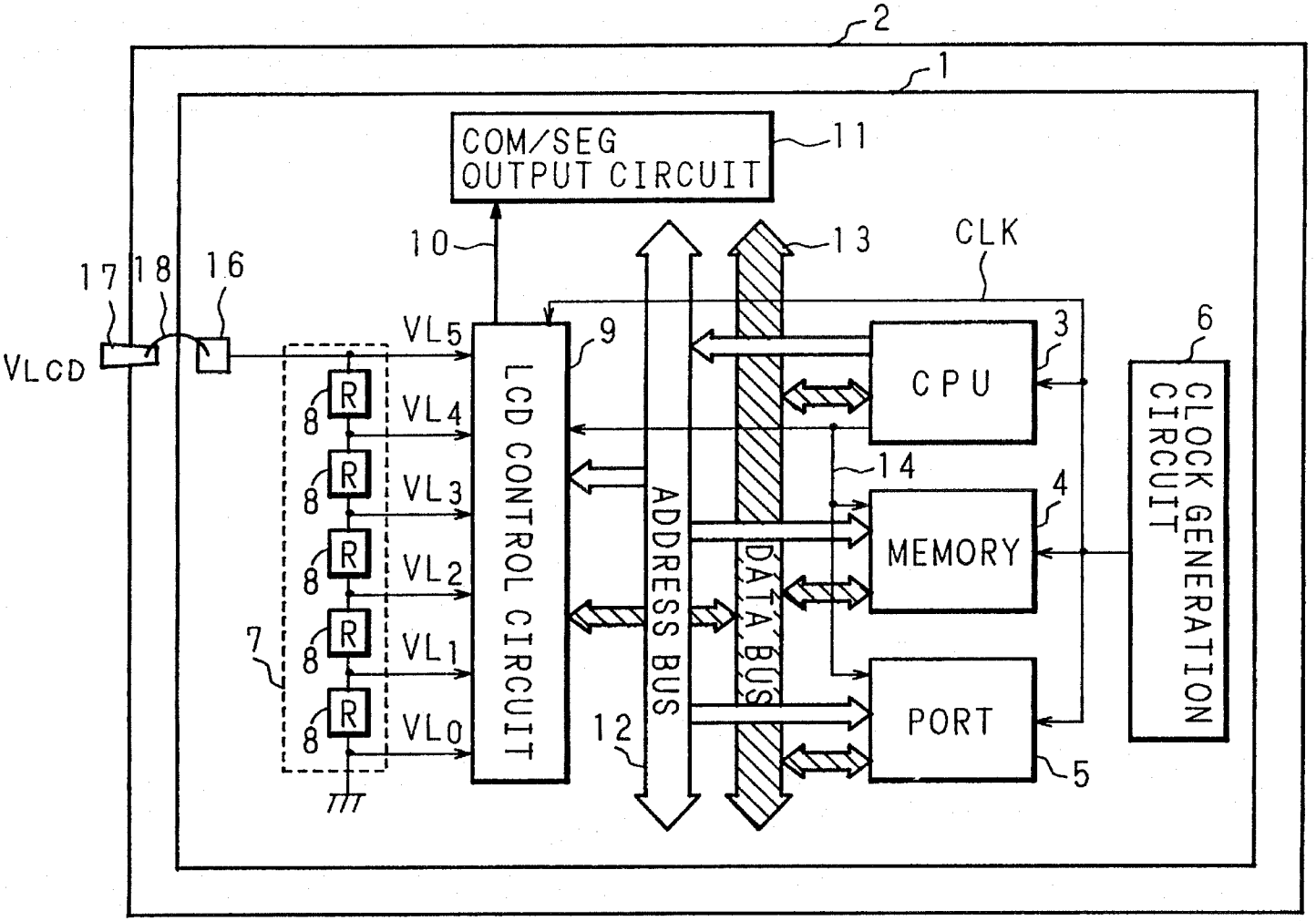
Fig. 1 Prior Art
FIG. 1 is a circuit block diagram showing the main portion of a conventional semiconductor integrated circuit device.
Figure 2:
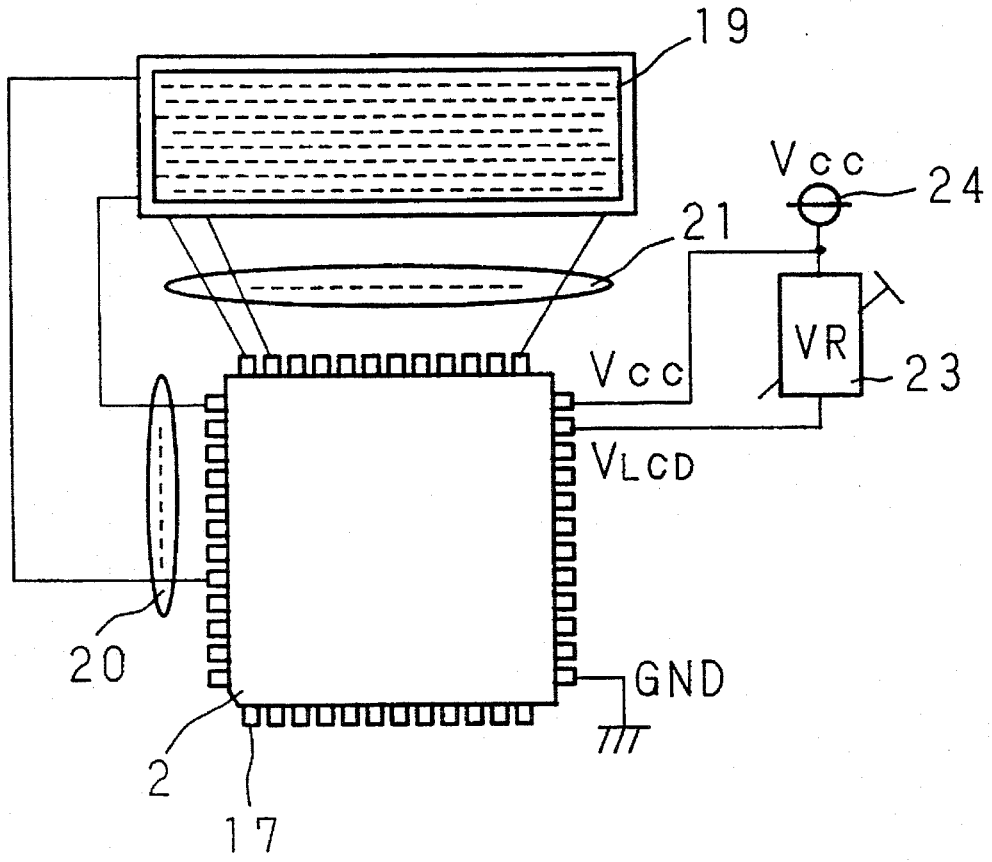
Fig. 2 Prior Art
FIG. 2 is a schematic diagram showing an example of the connection between the semiconductor integrated circuit device shown in FIG. 1 and the outside thereof.
Figure 3:
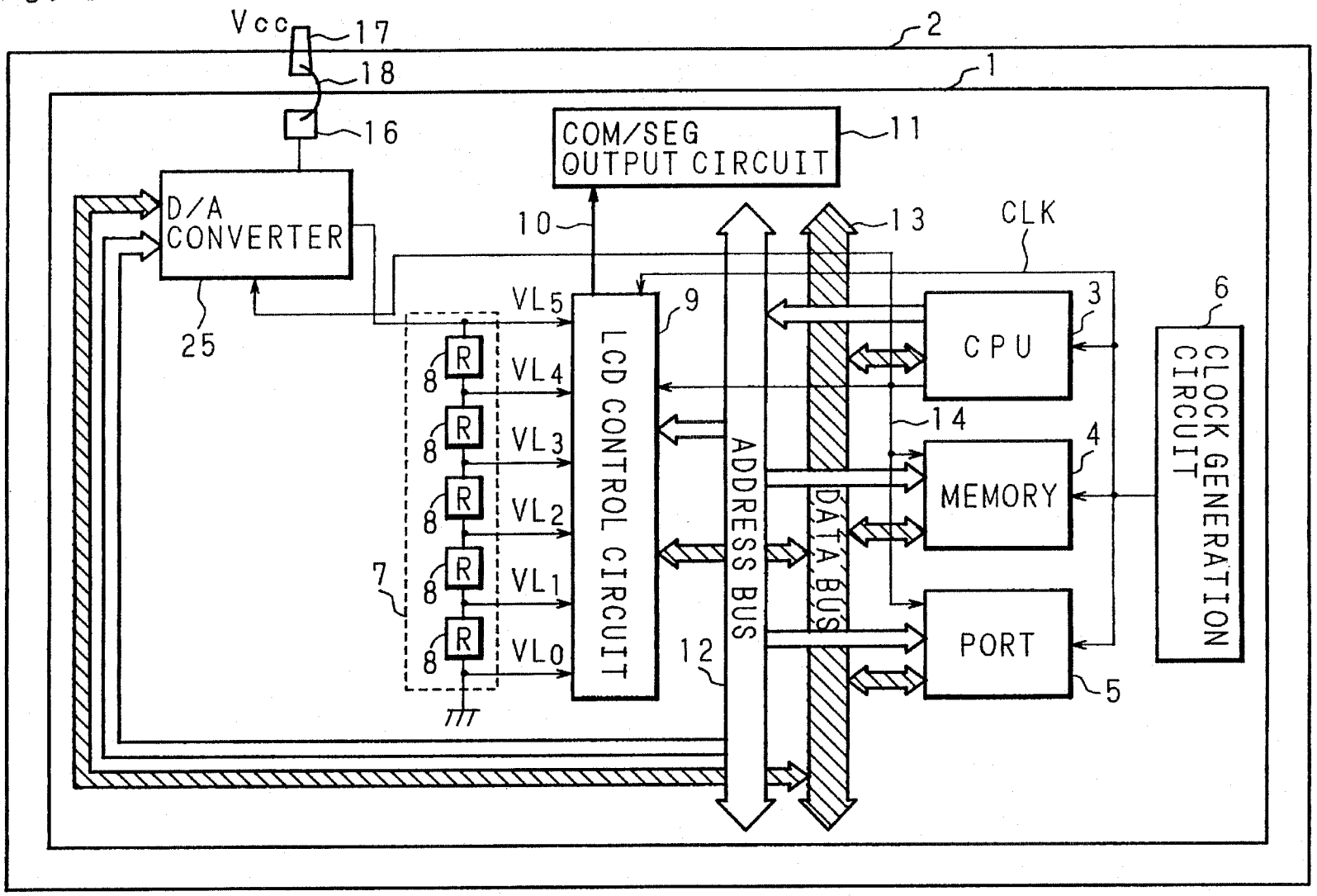
FIG. 3 is a circuit block diagram showing the main portion of a semiconductor integrated circuit device according to the present invention.

FIG. 3 is a circuit block diagram of the main portion of a semiconductor integrated circuit device according to the present invention, showing the constitution of a single-chip microcomputer in which a CPU, ROM, RAM, and other peripheral circuits are built in. In the drawing, numeral 1 designates a semiconductor chip held in a package 2. In the semiconductor chip 1 are installed the following circuits: the CPU 3; a memory 4 consisting of such built-in memories as the ROM and RAM; a port 5 for inputting or outputting digital signals such as an input signal, which is inputted via, e.g., a keyboard, or an output signal to a calculating circuit; an LCD control circuit 9 for outputting an LCD driving signal so that it is given to an LCD panel (see FIG. 2); an LCD driving voltage generating circuit 7 for generating a driving voltage so as to drive the LCD control circuit 9; and a COM/SEG output circuit 11 for outputting the LCD driving signal to the outside. A clock generating circuit 6 generates clock signals CLK which are given to the CPU 3, memory 4, port 5, and LCD control circuit 9. The CPU 3, memory 4, port 5, LCD control circuit 9, and a D/A converter 25 are connected to each other via an address bus 12 and data bus 13. The CPU 3 provides control signals 14, such as a read signal and write signal, to the memory 4, port 5, LCD control circuit 9, and D/A converter 25.

The LCD control circuit 9 is driven by the driving voltage generated by the LCD driving voltage generating circuit 7. Upon receiving the driving voltage, the LCD control circuit 9 outputs the LCD driving signal to the COM/SEG output circuit 11. To the LCD driving voltage generating circuit 7 is given a reference voltage 26 outputted by the D/A converter 25 serving as a reference voltage generating circuit. To the D/A converter 25 is applied a power-supply potential $V_{CC}$ via a terminal in the lead frame 17 attached to the package 2, wire 18 composed of a gold wire or the like, and pad 16 provided around the semiconductor chip 1. Output signals from the semiconductor chip 1 to the outside, including the LCD driving signal outputted from the COM/SEG output circuit 11, and input signals from the outside to the semiconductor chip 1 are all transmitted via the terminal in the lead frames 17, wire 18, and pad 16, though these signals are not shown in the drawing.

The LCD driving voltage generating circuit 7 in FIG. 3 shows an example of the 1/5 biased operation, similarly to the conventional embodiment, in which five resistances 8 having the same value of resistance R are connected in series between the D/A converter 25 and the ground so as to generate six different driving voltages $VL_0$ to $VL_5$.

Figure 4:
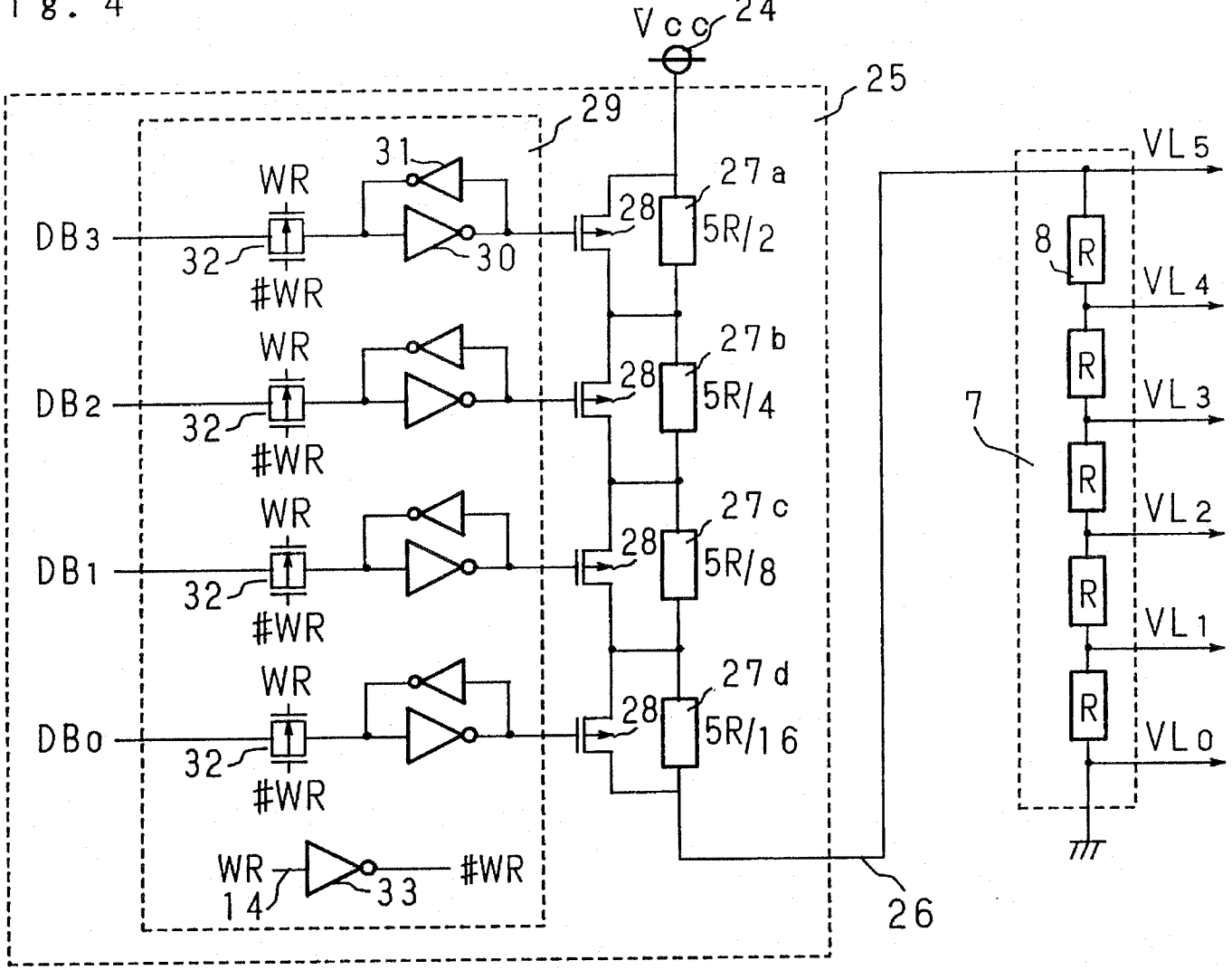
FIG. 4 is a circuit diagram showing a specific embodiment of the D/A converter in FIG. 3.

FIG. 4 is a circuit diagram showing a specific embodiment of the D/A converter 25 in FIG. 3, in which the voltage can be controlled at sixteen levels. Intended resistances 27*a*, 27*b*, 27*c*, and 27*d* having the values of resistance 5R/2, 5R/4, 5R/8, and 5R/16, respectively, are connected in series between a power supply 24 and the LCD driving voltage generating circuit 7. P-channel MOS transistors 28 are connected in parallel to the resistances 27*a*, 27*b*, 27*c*, and 27*d*, respectively. The gates of the P-channel MOS transistors 28 are connected to a 4-bit register circuit 29. The register circuit 29, which uses a so-called ratio-type latch, comprises four groups of inverters 30, inverters 31, and CMOS transmission gates 32. In each group, the input of the inverter 30 having a large driving capacity is connected to the output of the inverter 31 having a small driving capacity, while the output of the inverter 30 is connected to the input of the inverter 31, and the CMOS transmission gate 32 is connected on the input side of the inverter 30. To the CMOS transmission gates 32 are inputted sets of data $DB_0$, $DB_1$, DB2, and $DB_3$ for each bit, respectively, from the data bus 13. To each gate of the CMOS transmission gates 32 are inputted a write signal WR and inverted write signal #WR as the control signals 14. The inverted write signal #WR is generated by inverting the write signal WR by the inverter 33. The output side of the inverter 30 is connected to the gate of the corresponding P-channel MOS transistor 28.

Next, the operation will be described. When "1" is given to the CMOS transmission gate 32, the register circuit 29 outputs "0", thereby turning the P-channel MOS transistor 28 "on". Conversely, when "0" is given to the CMOS transmission gate 32, the register circuit 29 outputs "1", thereby turning the P-channel MOS transistor 28 "off".

In the register circuit 29 is written a value from 0 to F in hexadecimal code (0 to 15 in decimal code) as a voltage specifying signal. When F is written, for example, it follows that each of the CMOS transmission gates 32 is provided with "1", thereby turning each of the P-channel MOS transistors 28 "on". In this case, when the ON resistance of the P-channel MOS transistor 28 can be neglected, the reference voltage 26 outputted from the D/A converter 25 is equal to the power-supply potential $V_{CC}$. When 0 is written by the CPU 3, on the other hand, it follows that each of the CMOS transmission gates 32 is provided with "0", thereby turning each of the P-channel MOS transistors 28 "off", so that the reference voltage 26 becomes $V_{CC}\times16/31$. That is, when the voltage specifying signal is N (0 to 15 in decimal code), the reference voltage 26 can be represented by $V_{CC}\times16/(N+16)$. Thus, the reference voltages 26 at sixteen levels roughly from $V_{CC}/2$ to $V_{CC}$ can be obtained, so that the contrast can be controlled at sixteen levels accordingly. However, the present embodiment is disadvantageous in that the variation of the reference voltage 26 in response to the variation of the voltage specifying signal N is not constant.

Example 2

Figure 5:
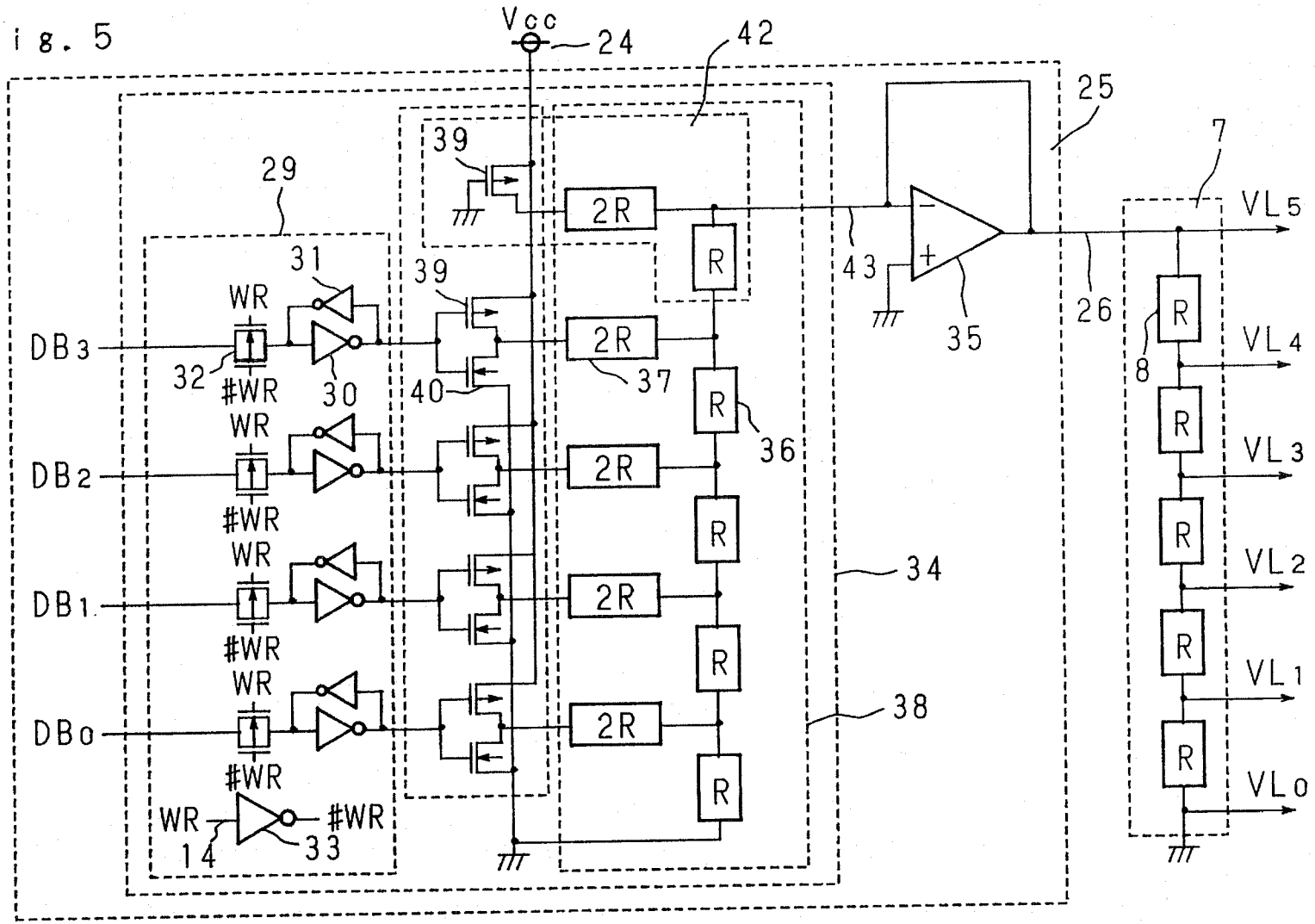
FIG. 5 is a circuit diagram showing another embodiment of the D/A converter.

FIG. 5 is a circuit diagram showing another embodiment of the D/A converter 25, in which the voltage can similarly be controlled at sixteen levels. The D/A converter 25 comprises a 4-bit R-2R-type D/A converting circuit 34, an operation amplifier 35, and the register circuit 29 same as used in the above embodiment. The R-2R-type D/A converting circuit 34 comprises a resistance ladder 38 consisting of Five resistances 36 having the resistance value R and five other resistances 37 having the resistance value 2R, which are combined in the shape of a ladder, and a switching circuit 41 for switching the voltage inputted to the resistances 37 either to the power-supply potential $V_{CC}$ or to the ground potential GND. The resistance 37 closest to the power supply 24 is connected to one terminal of the P-channel MOS transistor 39 which has the other terminal connected to the power supply 24. The gate of the P-channel MOS transistor 39 is connected to the ground. These resistances 36 and 37 and P-channel MOS transistor 39 constitute a circuit 42 for changing the reference voltage 26 outputted from the D/A converter 25 roughly from $V_{CC}/2$ to $V_{CC}$, not from the ground potential GND to the power-supply potential $V_{CC}$, in which the foregoing resistance ladder is extended by one bit so that the voltage is always applied to the resistances 37 from the $V_{CC}$ side.

The other four resistances 37 are connected to the individual connections between the P-channel MOS transistors 39 and N-channel MOS transistors 40 which are connected in series. The other terminals of the P-channel MOS transistors 39 are connected to the power supply 24, while the other terminals of the N-channel MOS transistors 40 are connected to the ground. The gate of the P-channel MOS transistor 39 and N-channel MOS transistor 40 in each bit is provided with an output of the register circuit 29.

The operation amplifier 35 presents a so-called source-follower constitution, in which the in-phase input side is at the ground potential GND, while the antiphase input side is provided with an output voltage 43 of the R-2R-type D/A converting circuit 34 and with the feedback of an output voltage of the operation amplifier 35. The output voltage of the operation amplifier 35 is inputted to the LCD driving voltage generating circuit 7 as the reference voltage 26. Except for the foregoing, the constitution of the semiconductor integrated circuit device is same as that of FIG. 3, so that the drawing thereof is omitted here.

The operation of the present embodiment will be described. In response to the voltage specifying signals N (0 to 15 in decimal code) obtained from the CPU 3, output voltages 43 at sixteen levels represented by $V_{CC}\times(N+17)/32$ are outputted from the R-2R-type D/A converting circuit 34. The operation amplifier 35 is for performing current amplification with respect to the voltage, and the reference voltage 26 is equal to the output voltage 43. In the present embodiment, the variation of the output voltage 43 in response to a change in the voltage specifying signal N is constant, resulting in excellent linearity.

Example 3

Figure 6:
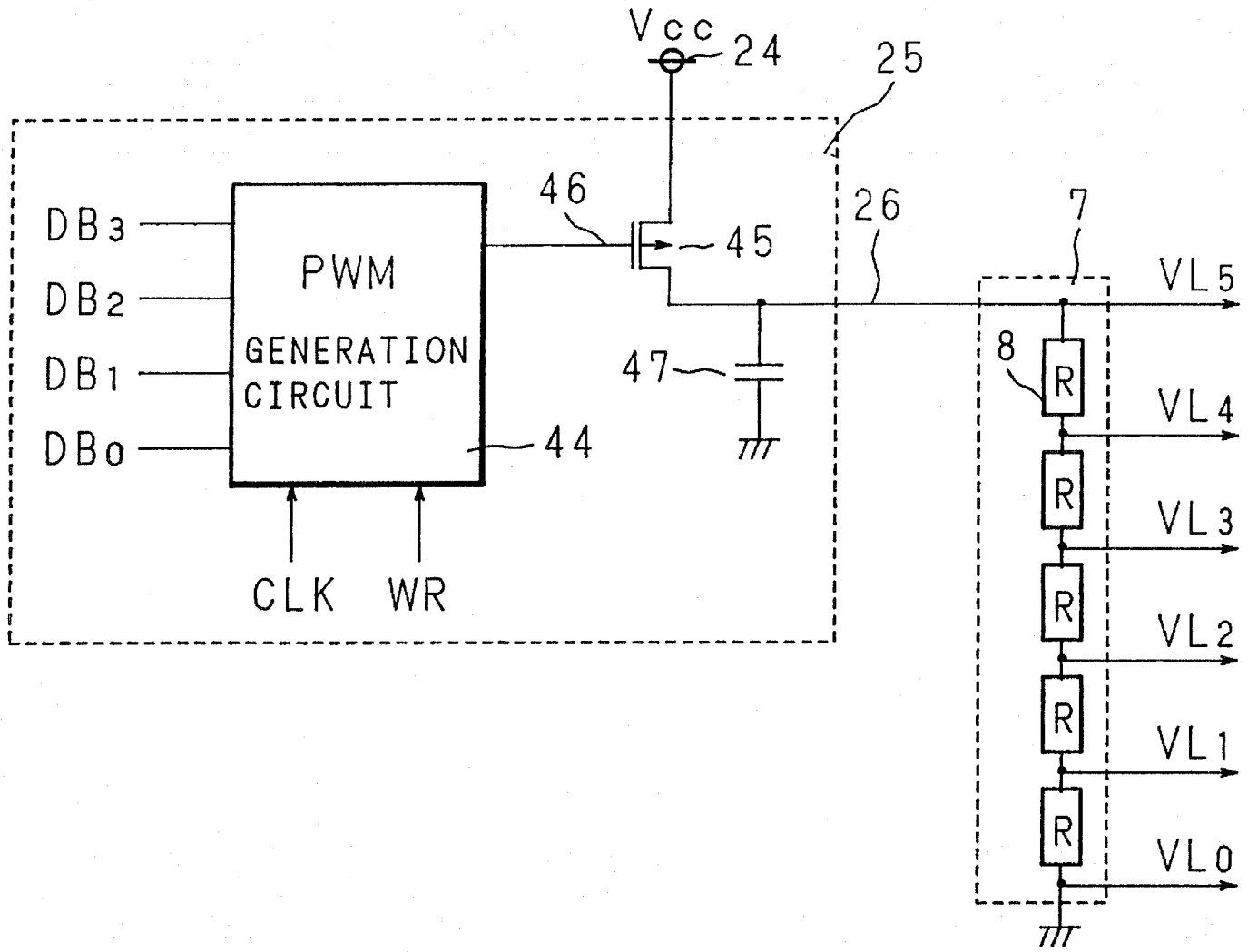
FIG. 6 is a circuit diagram showing still another embodiment of the D/A converter.

FIG. 6 is a circuit diagram showing still another embodiment of the D/A converter 25, in which a serial circuit consisting of a P-channel MOS transistor 45 and capacitor 47 is interposed between the power supply 24 and the ground potential, while the gate of the P-channel MOS transistor 45 is connected to the output terminal of a PWM generating circuit 44. The reference voltage 26 outputted from the D/A converter 25 is obtainable from the connection between the P-channel MOS transistor 45 and capacitor 47. The PWM generating circuit 44 is constituted so that sets of data $DB_0$ to $DB_3$ of the voltage specifying signal are inputted to the individual bits via the data bus 13 and, in addition, the clock signal CLK from the clock generating circuit 6 and the write signal WR are also inputted thereto, so that these values can change the output pulse width. Specifically, various constitutions can be considered in which, e.g., a counter and selector are used in combination, or an output of a timer is used. Except for the foregoing, the constitution is same as that of FIG. 3, so that the description thereof will be omitted here.

Figure 7:
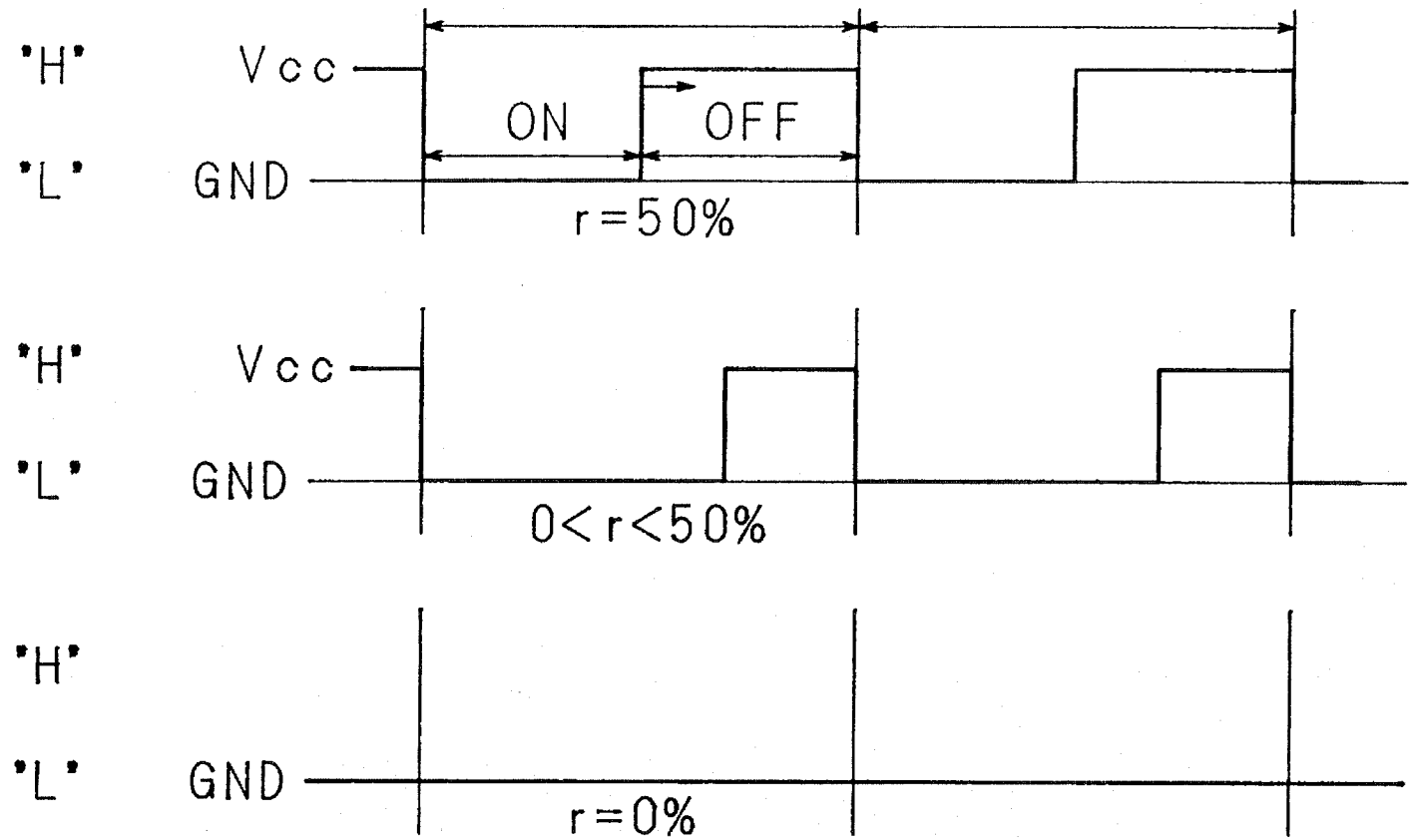
FIG. 7 is a view illustrating an output signal from a PWM generating circuit.

The operation of the present embodiment will be described. FIG. 7 is a view illustrating the output signal from the PWM generating circuit 44, in which the upper row shows the case in which a duty ratio r is 50%. Here, the P-channel MOS transistor 45 remains "on" while the output signal from the PWM generating circuit 44 is "L". Conversely, the P-channel MOS transistor 45 remains "off" while the output signal from the PWM generating circuit 44 is "H". The intermediate row shows the case in which $0<r<50\%$, and the lower row shows the case in which $r=0$.

With the constitution which enables the PWM generating circuit 44 to output a waveform whereby the duty ratio r reaches a desired level within the range $0 \leqq r \leqq 50\%$, the "on" period of the P-channel MOS transistor 45 changes in accordance with the duty ratio r of the output waveform, so that the electric power supplied to the LCD driving voltage generating circuit 7 can be controlled according to the number of the foregoing levels. Here, the capacitor 47 is for smoothing the voltage.

Example 4

Figure 8:
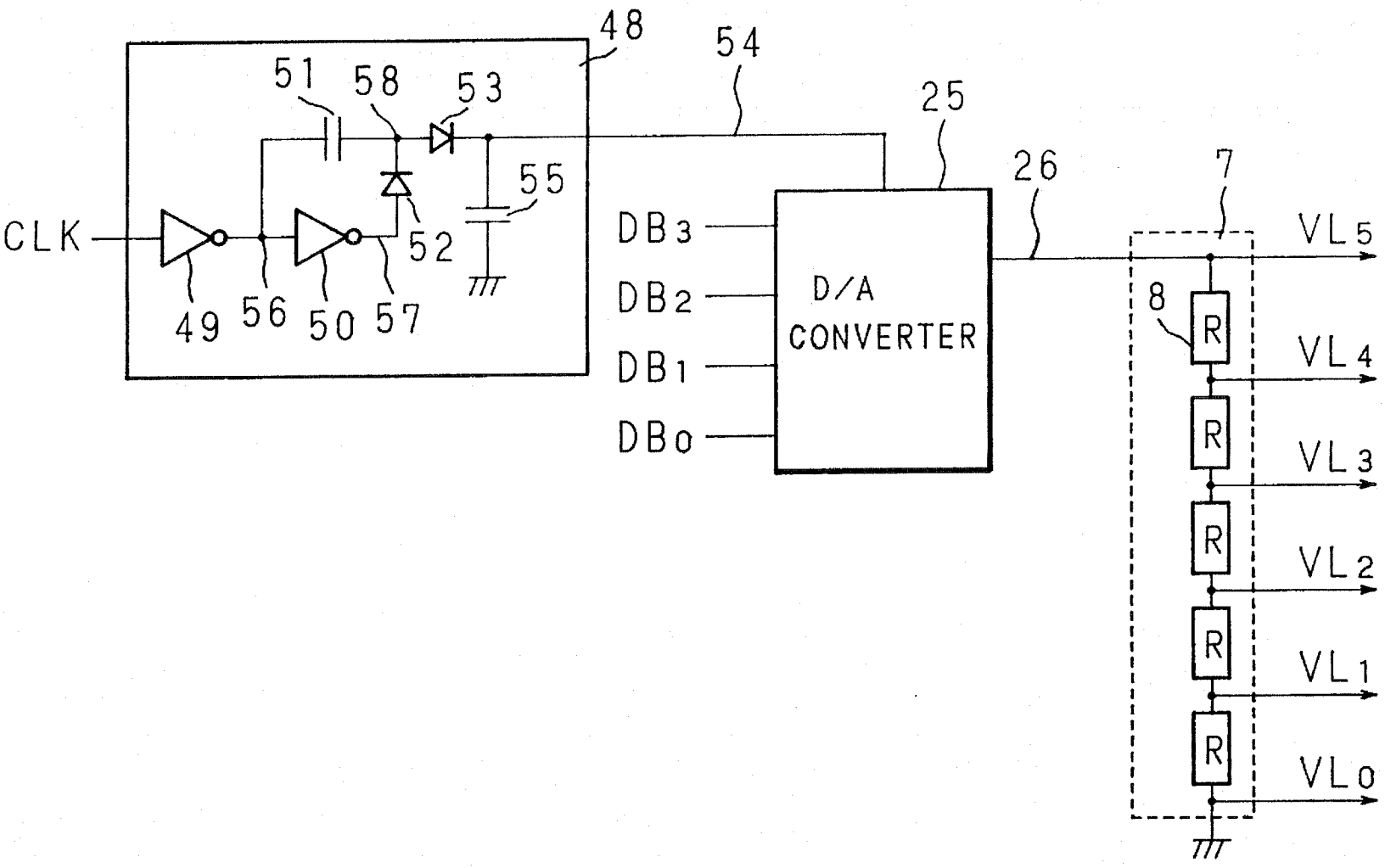
FIG. 8 is a circuit diagram showing another embodiment of the device of the present invention.

FIG. 8 is a circuit diagram of still another embodiment of the semiconductor integrated circuit device according to the present invention, which exclusively shows the main portion thereof. The present embodiment comprises a booster circuit 48 for boosting the power-supply voltage on the power-supply side of the D/A converter 25 inside the semiconductor chip 1. Since it is difficult to light up the LCD panel with a driving voltage lower than, e.g., 3 volt, a booster circuit is required in case of operating a microcomputer with a voltage lower than 3 volt. FIG. 8 shows an example of the double booster circuit using a diode. The booster circuit 48 consists of inverters 49 and 50 and diodes 52 and 53 connected in series, which are operable with the power-supply voltage $V_{CC}$. To the inverter 49 is inputted the clock signal CLK, in which "H" is the power-supply potential $V_{CC}$ and "L" is the ground potential GND. The inverter 50 and diode 52 connected in series are further connected to a capacitor 51 in parallel. The output side (P side) of the diode 53 is connected to a capacitor 55 having its one terminal connected to the ground. The output voltage 54 of the booster circuit 48 can be obtained from the P side of the diode 53, so that it is supplied to the D/A converter 25. The circuit of the D/A converter 25 can be constituted similarly to the circuits used in the first to third embodiments. Except for the foregoing, the constitution is same as that of FIG. 3, so that the description thereof will be omitted.

The operation of the present embodiment will be described. When the clock signal CLK is "H", the (output) voltage 56 of the inverter 49 is "L" and the (output) voltage 57 of the inverter 50 is "H". In the capacitor 51, therefore, the voltage 56 on the side of the inverter 49 is "L", while the voltage 58 on the side of the diode 53 is "H". When the clock signal CLK becomes "L", the (output) voltage 56 of the inverter 49 becomes "H", while the (output) voltage 57 of the inverter 50 becomes "L". However, the voltage 58 becomes $2V_{CC}$, not "L", due to the diode 52. Consequently, the booster circuit 48 constantly outputs the output voltage 54 of $2V_{CC}$. Here, the capacitor 55 is provided for the purpose of smoothing the voltage. With the operation described above, when the power-supply voltage $V_{CC}$ is, e.g., 2.5 volt, the voltage of 5 volt is inputted to the D/A converter 25. This enables displaying on the LCD panel.

Example 5

Figure 9:
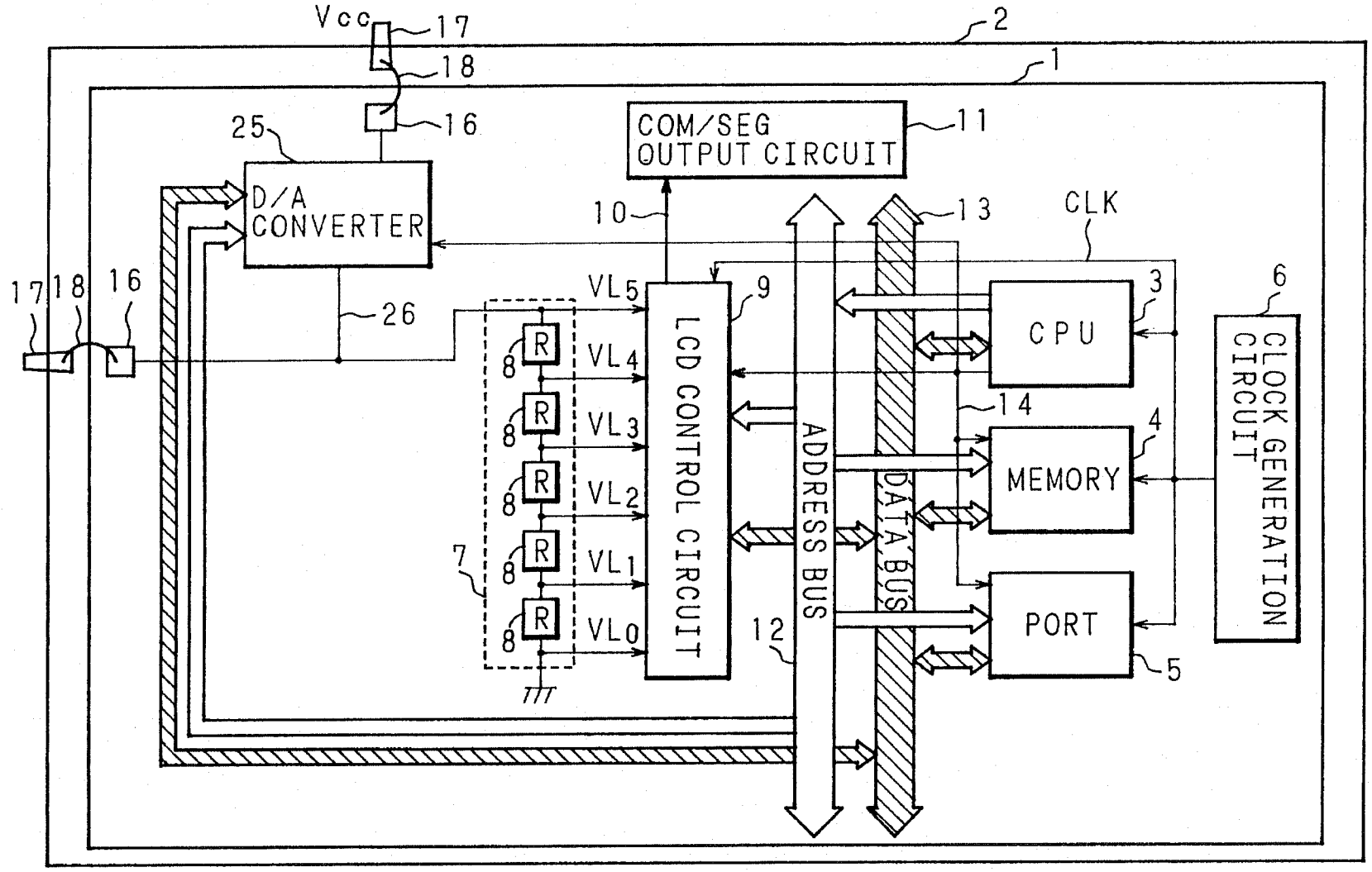
FIG. 9 is a circuit block diagram showing still another embodiment of the device of the present invention.

FIG. 9 is a circuit block diagram showing still another embodiment of the semiconductor integrated circuit device according to the present invention. In the present embodiment, the reference voltage 26 outputted from the D/A converter 25 can be outputted to the outside via the pad 16, wire 18, and lead flame 17. Except for the foregoing, the constitution is equal to that of FIG. 3, so that the description thereof will be omitted here by providing the same numerals.

With the constitution mentioned above, the reference voltage 26 can be used not only for controlling the contrast of the LCD panel in the semiconductor chip 1, but also for other external circuits. For example, in the case where the LCD panel is considerably large and therefore a plurality of LSIs for controlling the LCD are used to control the single LCD, when the voltages for driving the LSIs are different, the contrast is not controlled uniformly, so that the use of the same driving voltage is required. The present embodiment is applicable to such an device, for it exerts an effect of providing the plurality of LSIs for controlling the LCD with the same LCD driving reference voltage. The present embodiment can also be used in a circuit other than the LSIs for controlling the LCD.

Example 6

Figure 10:
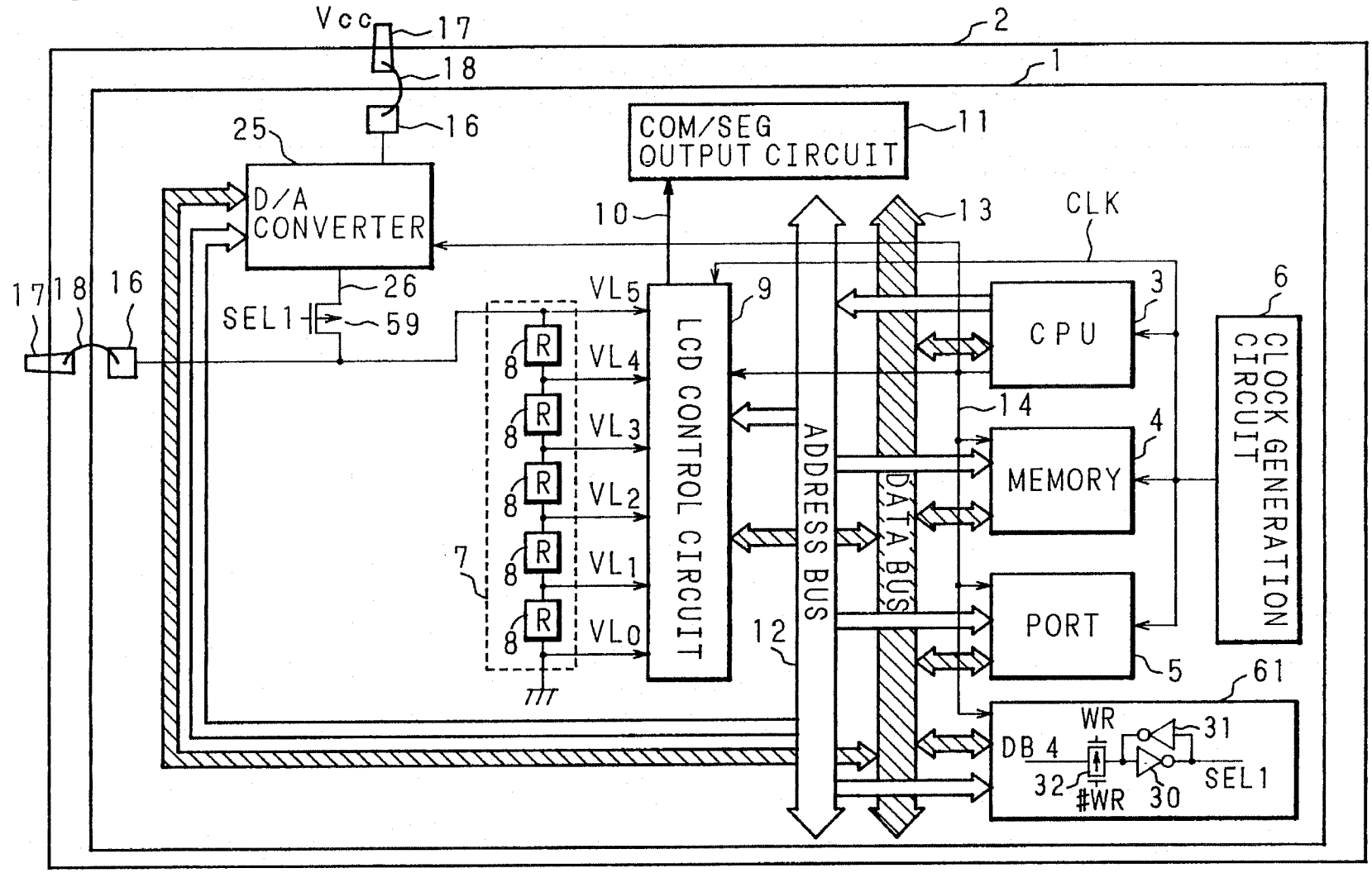
FIG. 10 is a circuit block diagram showing still another embodiment of the device of the present invention.

Some users may install the single-chip microcomputer in an device which uses the reference voltage provided outside the single-chip microcomputer in order to control the contrast of the LCD. When such a single-chip microcomputer as shown in FIG. 9 is installed in the device, the contrast control is affected by the reference voltage 26, resulting in the deterioration of accuracy with which the contrast is controlled. FIG. 10 is a circuit block diagram showing still another embodiment of the device of the present invention, which solves the aforesaid problem. The present embodiment comprises a P-channel MOS transistor 59 between the D/A converter 25 and LCD driving voltage generating circuit 7. The connection between the P-channel MOS transistor 59 and LCD driving voltage generating circuit 7 is connected to the pad 16, so that the reference voltage 26 can be given to the LCD driving voltage generating circuit 7 and also to the outside via the P-channel MOS transistor 59. In addition, the present embodiment comprises a mode register 61 which is controlled by the control signal 14 from the CPU 3. The foregoing address bus 12 and data bus 13 are also connected to the mode register 61.

The mode register 61 generates a gate signal SEL1 for controlling the on-off operation of the P-channel MOS transistor 59. The mode register 61, which uses a so-called ratio-type latch, comprises the inverter 30 having a large driving capacity, inverter 31 having a small driving capacity, and CMOS transmission gate 32. In the mode register 61, the input of the inverter 30 is connected to the output of the inverter 31, while the output of the inverter 30 is connected to the input of the inverter 31, and the CMOS transmission gate 32 is connected on the input side of the inverter 30. To the CMOS transmission gate 32 is inputted the data $DB_4$ via the data bus 13. To each gate of the CMOS transmission gates 32 is inputted the write signal WR and inverted write signal #WR as the control signals 14. The signal outputted from the inverter 30 is inputted to the gate of the P-channel MOS transistor 59 as the gate signal SEL1. Except for the foregoing, the constitution is same as that of FIG. 3, so that the description thereof will be omitted here by providing the same numerals.

The operation of the present embodiment will be described. The P-channel MOS transistor 59 is turned on when the gate signal SEL1 is "L" and is turned off when the gate signal SEL1 is "H". Therefore, in the case where a reference voltage other than the reference voltage 26 is inputted from the outside to the LCD driving voltage generating circuit 7, when the gate signal SEL1 is set to "H", it is possible to prevent the reference voltage 26 from affecting the LCD driving voltage generating circuit 7. In the present embodiment, the setting is conducted by the data $DB_4$ outputted from the CPU 3.

With the above constitution, it is possible in the present embodiment to set the output impedance of the D/A converter 25 in the state of high impedance, so that the contrast of the LCD panel can be controlled with high accuracy either with the reference voltage 26 from the built-in D/A converter 25 or with the reference voltage supplied from the outside.

Example 7

Figure 11:
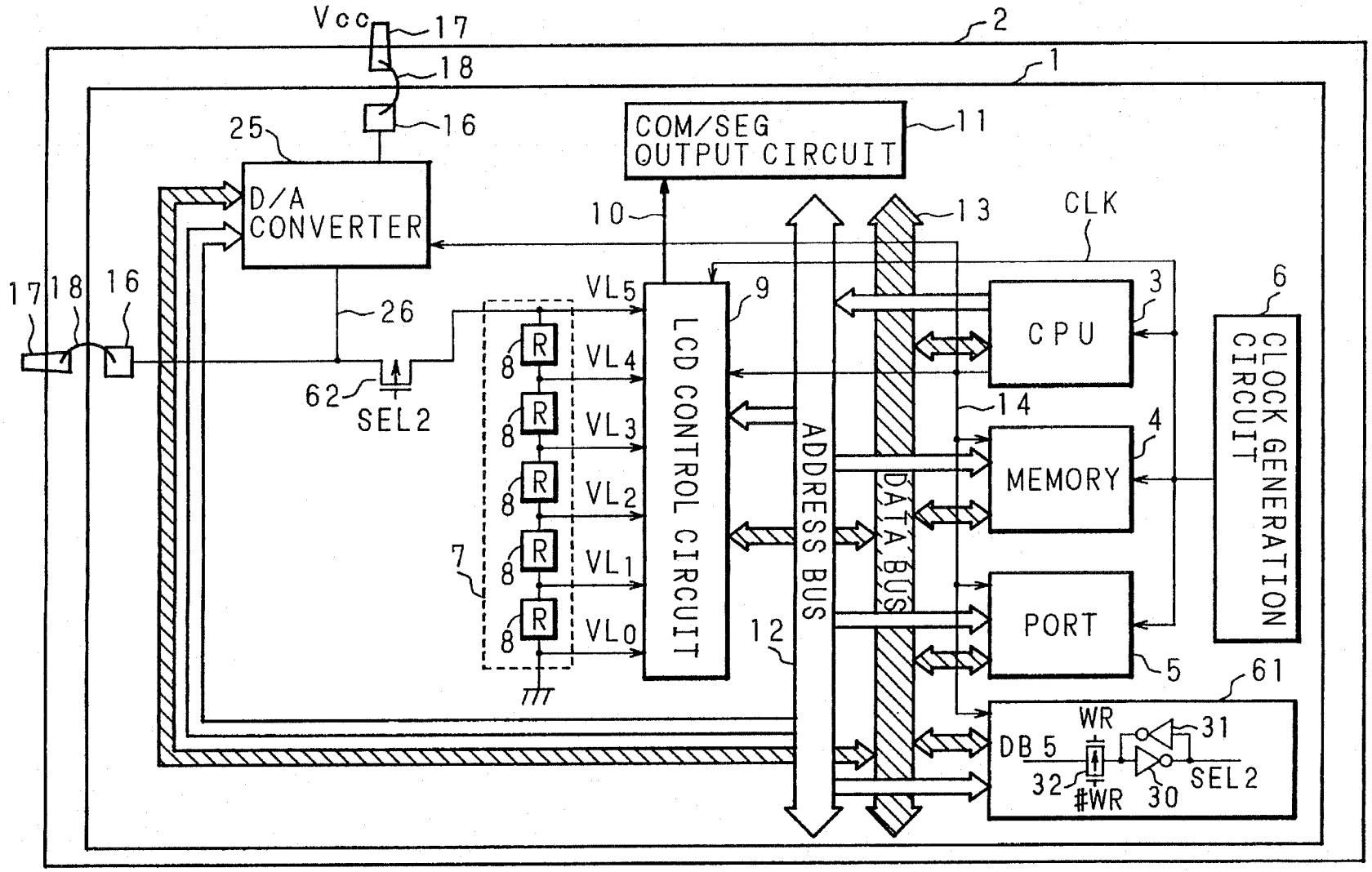
FIG. 11 is a circuit block diagram showing still another embodiment of the device of the present invention.

FIG. 11 is a circuit block diagram showing still another semiconductor integrated circuit device according to the present invention. The present embodiment comprises a P-channel MOS transistor 62 between the D/A converter 25 and LCD driving voltage generating circuit 7. The connection between the D/A converter 25 and P-channel MOS transistor 62 is connected to the pad 16 to connected the lead frame 17 via the wire 18. The present embodiment also comprises the mode register 61 of the same constitution as that of the sixth embodiment. When the data $DB_5$ is inputted from the data bus 13 to the MOS transmission gate 32 of the mode register 61, the mode register 61 generates a gate signal SEL2 which controls the on-off operation of the P-channel MOS transistor 62. Except for the foregoing, the constitution of the present embodiment is same as that of FIG. 10, so that the description thereof will be omitted here by providing like numerals.

The operation of the present embodiment will be described. The P-channel MOS transistor 62 is turned on when the gate signal SEL2 is "L" and is turned off when the gate signal SEL2 is "H". Therefore, in the case where the operation of the displaying function of the LCD is not needed, when the gate signal SEL2 is set to "H", it is possible to prevent the reference voltage 26 from being applied to the LCD driving voltage generating circuit 7. In the present embodiment, the setting is conducted by the data $DB_5$ outputted from the CPU 3.

With the above constitution, it is possible in the present embodiment to set the input impedance of the LCD driving voltage generating circuit 7 in the state of high impedance. Consequently, when the reference voltage 26 is supplied to a circuit outside the semiconductor chip 1, not to the LCD driving voltage generating circuit 7, the reference voltage 26 is not affected by the variation of the input impedance of the LCD driving voltage generating circuit 7. Hence, the output voltage can be collected from the D/A converter 25 with high accuracy, so that, e.g., the characteristic of the D/A converter 25 can be measured with ease and high precision in a delivery inspection.

Example 8

Figure 12:
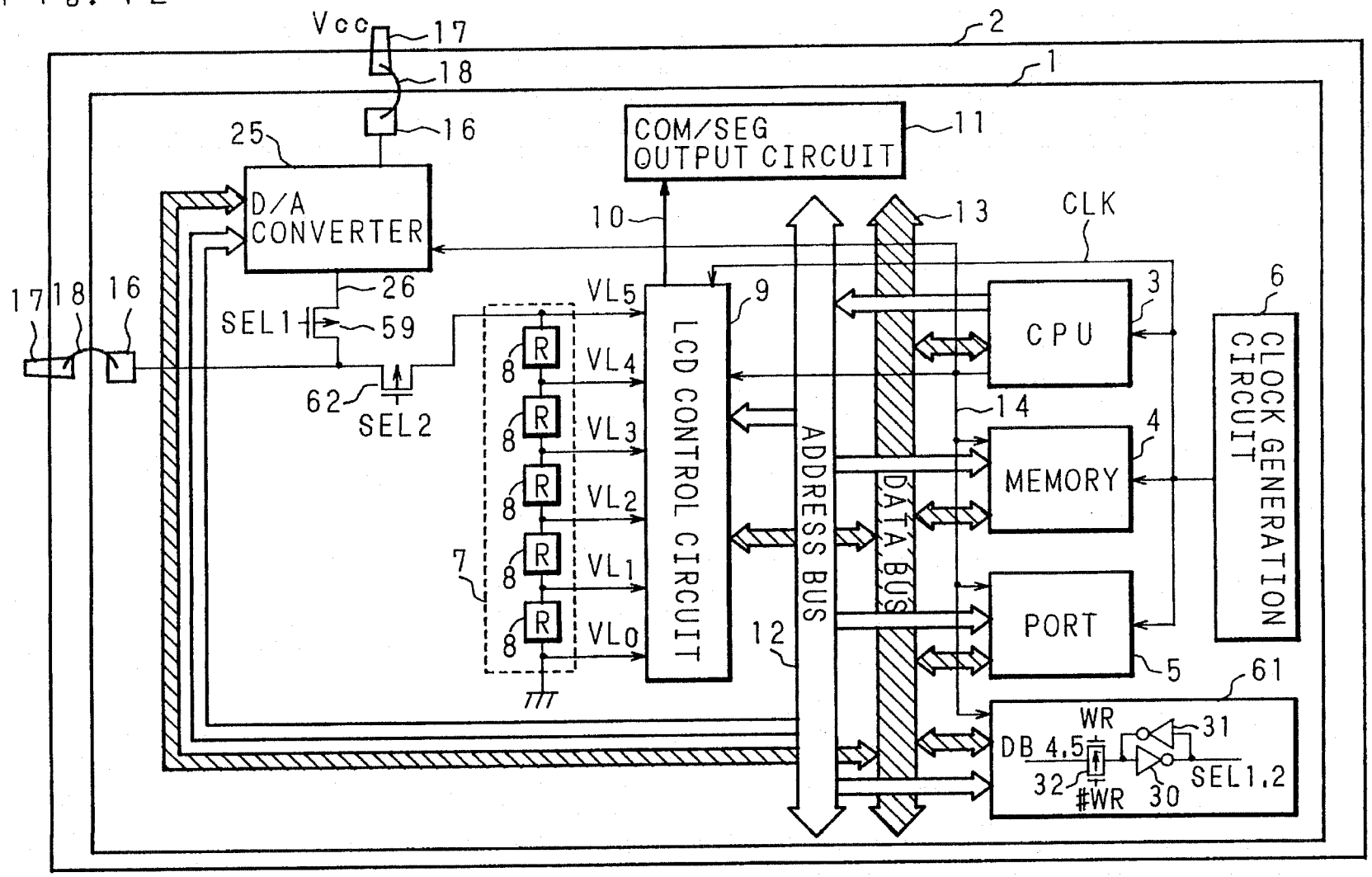
FIG. 12 is a circuit block diagram showing still another embodiment of the device of the present invention.

FIG. 12 shows the constitution of an embodiment, which is a combination of the sixth and seventh embodiments, in which both output side of the D/A converter 25 and input side of the LCD driving voltage generating circuit 7 can be set in the state of high impedance. In other words, the present embodiment comprises the P-channel MOS transistors 59 and 62 between the D/A converter 25 and LCD driving voltage generating circuit 7. The connection between the P-channel MOS transistors 59 and 62 is connected to the pad 16. Upon receiving the data $DB_4$ or data $DB_5$, the mode register 61 outputs the gate signals SEL1 or SEL2.

In the present embodiment, it is possible to put the desired position in the state of high impedance due to the data $DB_4$ and data $DB_5$, and the semiconductor integrated circuit device according to the present invention can easily be used properly for different purposes as shown in the sixth and seventh embodiments.

Example 9

In general, the contrast of the LCD panel tends to lower as the ambient temperature lowers. In this case, it is required to increase the contrast by increasing the LCD driving voltage, i.e., the reference voltage inputted to the LCD driving voltage generating circuit 7. Explanation will now be given to an embodiment which satisfies the requirement.

Figure 13:
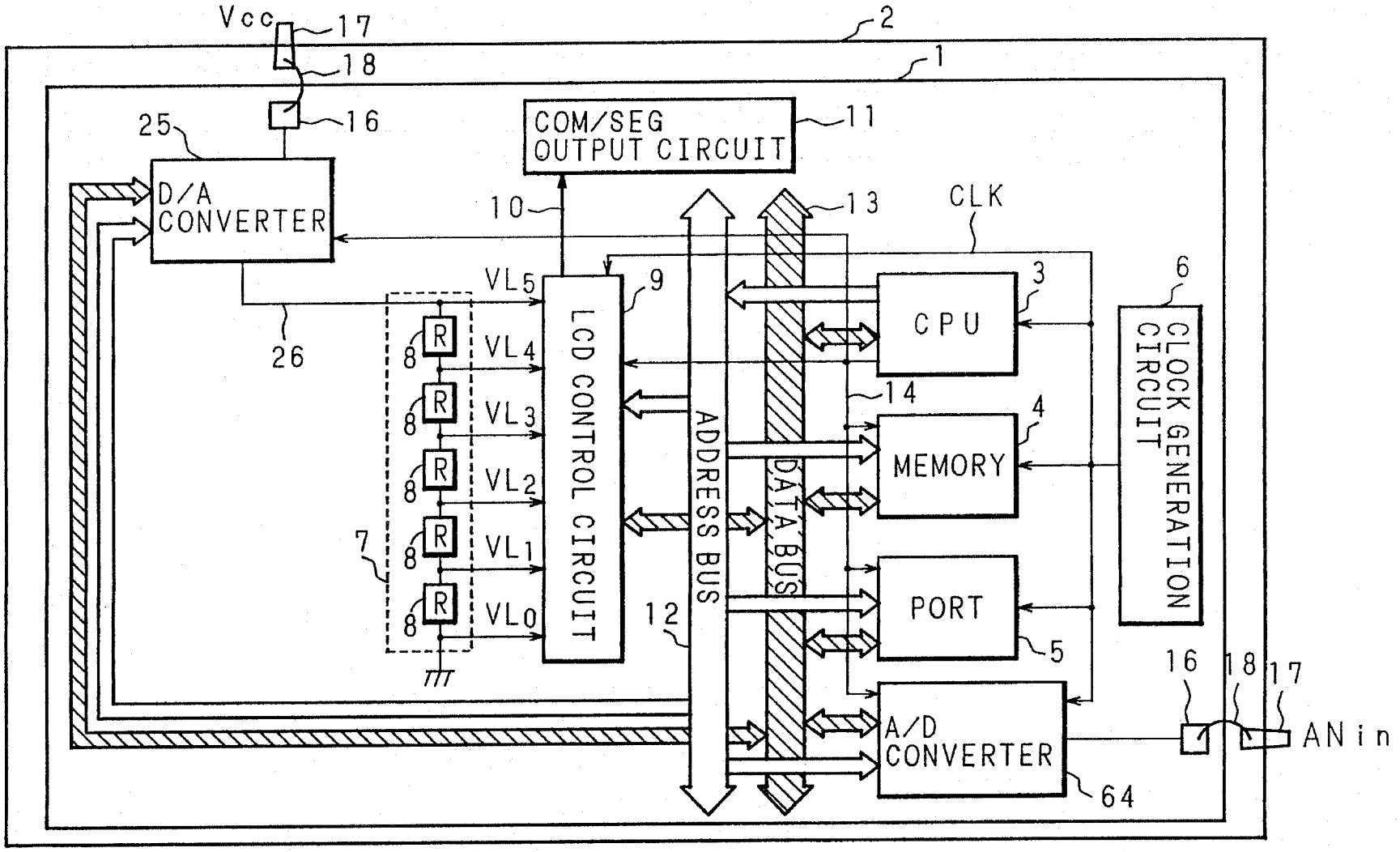
FIG. 13 is a circuit block diagram showing still another embodiment of the device of the present invention.

FIG. 13 is a circuit block diagram showing still another embodiment of the semiconductor integrated circuit device according to the present invention. The semiconductor integrated circuit device in the present embodiment comprises an A/D converter 64 for converting an analog voltage value ANin, which is supplied from the outside via the lead frame 17, wire 18, and pad 16, to a digital value. The operation of the A/D converter 64 is controlled by the control signal 14 from the CPU 3. The foregoing address bus 12 and data bus 13 are also connected to the A/D converter 64. The A/D converter 64 can be of successive approximation type or integration type in terms of its circuit constitution. The number of bits may properly be selected according to its resolution. The detailed description of the A/D converter 64 will be omitted here. Except for the foregoing, the constitution is same as that of FIG. 3, so that the description thereof will be omitted here by providing the same numerals.

Figure 14:
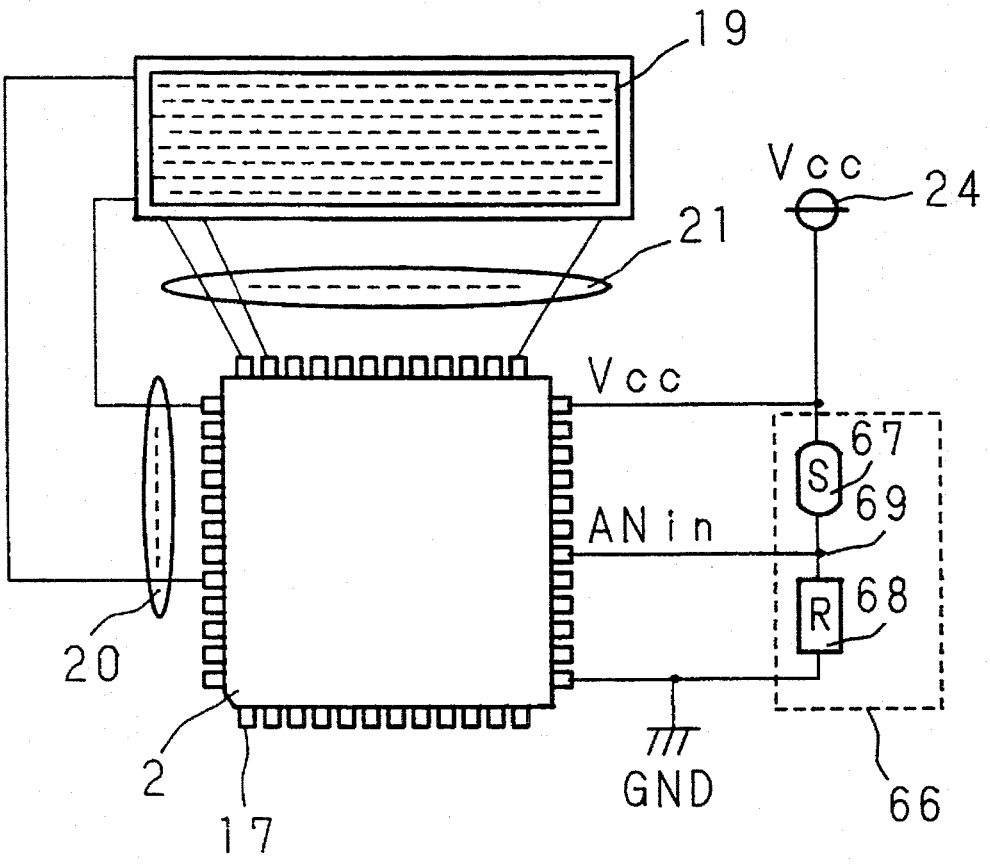
FIG. 14 is a schematic diagram showing the peripheral constitution around the semiconductor integrated circuit device shown in FIG. 13.

FIG. 14 is a schematic diagram showing the peripheral constitution around the semiconductor integrated circuit device shown in FIG. 13, in which the analog voltage value ANin is outputted from a temperature detector 66 connected between the power supply 24 and the device of the present invention (only the package 2 thereof is shown). The temperature detector 66 consists of a thermistor 67 and resistance 68 which are connected in series. The analog voltage value ANin is outputted from the connection between the thermistor 67 and resistance 68. Among the large number of terminals in the lead frames 17 attached to the package 2, several are connected to the LCD panel 19 via the COM terminal 20 or SEG terminal 21. Another terminal in the lead frames 17 are connected to the power supply 24 and another lead frame 17 is connected to the ground so that the power-supply potential $V_{CC}$ and ground potential GND are supplied to the device of the present invention (2).

In the following, the operation of the present embodiment will be described. In general, when the ambient temperature is reduced, the resistance value of the thermistor 67 is also reduced due to its characteristics. Therefore, when the ambient temperature is increased, the analog voltage value ANin outputted from the temperature detector 66 is also increased. Conversely, when the ambient temperature is reduced, the analog voltage value ANin is also reduced. The A/D converter 64 converts, under the control of the CPU 3, the variable analog voltage value ANin to a digital value in accordance with the magnitude of the analog voltage value ANin. The resulting digital value is read by the CPU 3, and the CPU 3 in turn gives the voltage specifying signal to the D/A converter 25. With the above constitution, an automatic contrast controlling function can be realized.

Figure 15:
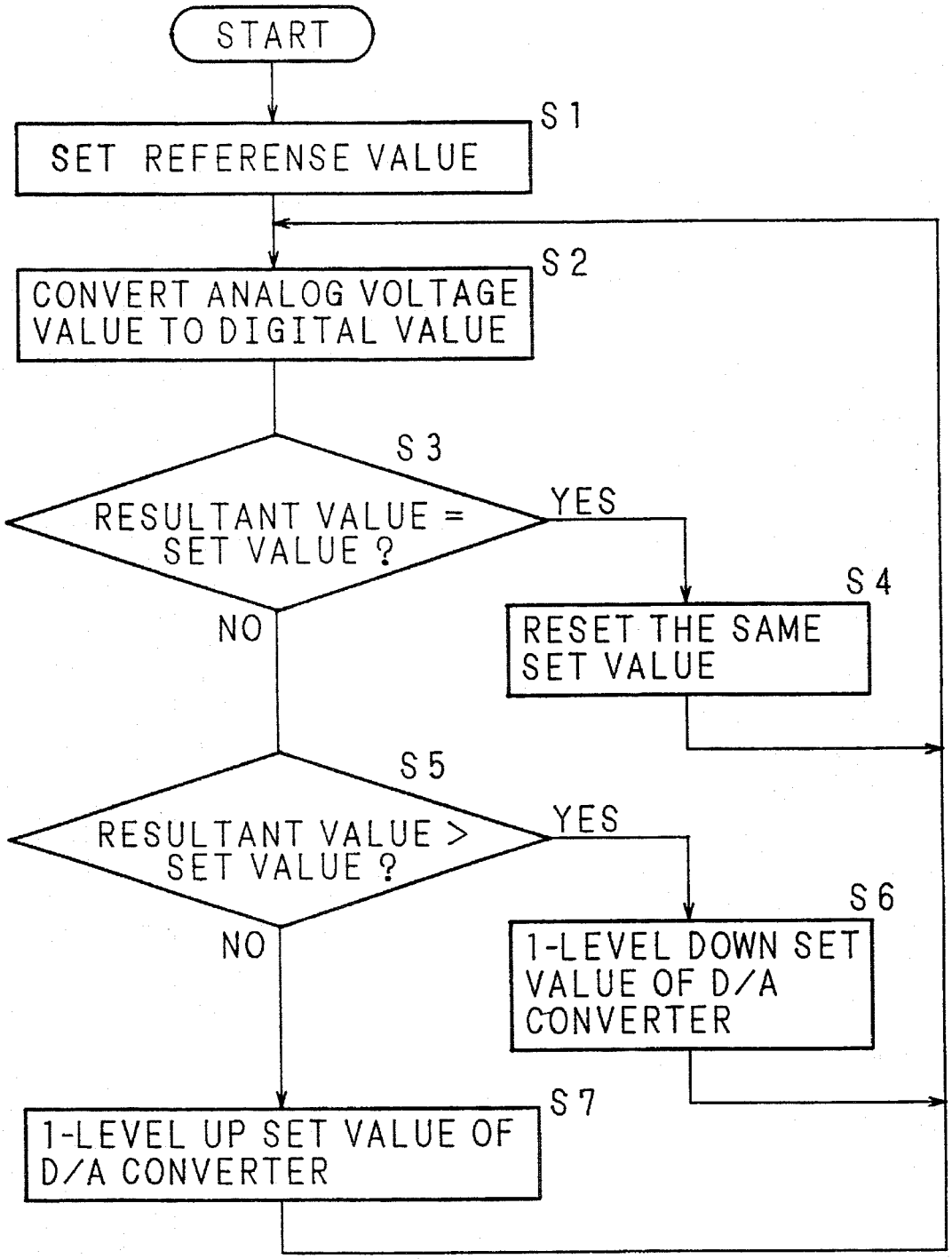
FIG. 15 is a flow chart showing the procedure to be performed in the CPU shown in FIG. 13.

FIG. 15 is a flow chart showing the procedure performed in the CPU 3 at this time. At first, the reference value of the A/D converter 64 and the reference value of the D/A converter 25 in normal conditions are set (Step S1). Then, the analog voltage value ANin outputted from the temperature detector 66 at a specified period is subjected to the A/D conversion (Step S2), so as to judge whether or not the value resulting from the A/D conversion is same as the above reference value (set value) of the A/D converter 64 (Step S3). When it is judged to be same, the set value of the D/A converter 25 is reset to the original set value (Step 4), thereby returning to Step S2. When it is judged that the resultant value is not same as the set value in Step S3, it is further judged whether or not the resultant value is larger than the set value (Step S5). When the resultant value is larger than the set value, the set value of the D/A converter 25 is reduced by one level (Step S6). Conversely, when the resultant value is not larger than the set value, the set value of the D/A converter 25 is increased by one level, thereby processing returns to Step S2. The above procedure is repeatedly performed till the power supply is turned off.

It will be appreciated that the temperature detector 66 may have another constitution. It is also possible to transmit the voltage specifying signal from the outside to the D/A converter 25 through the serial communicating function, without using the CPU 3 as described above, thereby controlling the contrast.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A semiconductor integrated circuit device connected to a power supply providing a power-supply voltage and provided with a circuit for driving a liquid-crystal display panel on the basis of a control signal output from a CPU via an address bus and a data bus, comprising:

a liquid-crystal control circuit for generating a driving signal for driving the liquid-crystal display panel;

a driving voltage generating circuit connected to said liquid-crystal control circuit, receiving a reference voltage and generating a voltage for driving said liquid-crystal control circuit responsive to the reference signal; and a reference voltage generating circuit connected to said driving voltage generating circuit for transforming the power-supply voltage responsive to the control signal received from said CPU into the reference voltage and for transmitting the reference voltage to said driving voltage generating circuit, wherein said reference voltage driving circuit comprises brightness level circuits, each of said brightness level circuits including a register receiving the control signal from the CPU, the control signal including data signals to control illumination of the liquid crystal display panel via the data bus and a write signal and an address signal via the address bus;

a transistor connected to said register, wherein the write signal controls activation of said transistor and transmission of the data signals, and the write signal and the data signals which are input to said register by the write signal control the reference voltage output from said reference voltage generating circuit;

a resistance ladder connected to said transistor including first and second resistances, the first resistances connected in series and each of the second resistances connected between and in parallel with the first resistances and said transistor forming a ladder shape; and an operational amplifier connected to said resistance ladder.

2. A semiconductor integrated circuit device according to claim 1, further comprising a terminal for outputting to the outside an output of said reference voltage generating circuit.

3. A semiconductor integrated circuit device according to claim 1, wherein said reference voltage generating circuit is a D/A converting circuit which said voltage specifying signal is inputted to and outputs said reference voltage as an output and which said power-supply voltage is given to.

4. A semiconductor integrated circuit device according to claim 1, wherein said reference voltage generating circuit comprises a PWM generating circuit.

5. A semiconductor integrated circuit device according to claim 2, wherein the output side of said reference voltage generating circuit can be in the state of high impedance.

6. A semiconductor integrated circuit device according to claim 2, wherein the input side of said driving voltage generating circuit can be in the state of high impedance.

7. A semiconductor integrated circuit device according to claim 3, further comprising a booster circuit for boosting said power-supply voltage and supplying the boosted voltage to said D/A converting circuit.

8. A semiconductor integrated circuit device according to claim 3, further comprising an A/D converting circuit for converting an analog voltage value supplied from the outside to a digital value and outputting the resultant digital value to said CPU.

9. A semiconductor integrated circuit device according to claim 1, wherein said operational amplifier includes in-phase and anti-phase inputs, and wherein the in-phase input is connected to ground potential and the anti-phase input is connected to said resistance ladder receiving an output voltage from said resistance ladder.

10. A semiconductor integrated circuit device according to claim 1, wherein said operational amplifier is provided with a first output voltage of said resistance ladder and a second output voltage fed back from said operational amplifier.

11. A semiconductor integrated circuit device according to claim 1, wherein said operational amplifier is a CMOS operational amplifier in a source-follower construction for generating the reference voltage.

12. A semiconductor integrated circuit device according to claim 1, wherein the first resistances comprise a first resistance value R and the second resistances comprise a second resistance value 2R forming an R-2R resistance ladder.

13. A semiconductor integrated circuit device according to claim 1, wherein said transistor for each of said brightness level circuits includes a combination of a P-channel MOS transistor and an N-channel MOS transistor connected in series.

14. A semiconductor integrated circuit device according to claim 13, wherein the P-channel MOS transistor is further connected to power and the N-channel MOS transistor is further connected to ground, and gates of the P-channel and N-Channel MOS transistors are connected to said register.

15. A semiconductor integrated circuit device according to claim 1, further comprising a terminal for outputting to the outside an output of said reference voltage generating circuit to be used to control external circuits and the contrast of a display associated therewith as well as to control internal circuits and the contrast of the liquid-crystal display panel associated therewith.

16. A semiconductor integrated circuit device according to claim 1, wherein the output side of said reference voltage generating circuit is potentially in a state of high impedance, and wherein when the reference voltage supplied to said driving voltage generating circuit is from outside said semiconductor integrated circuit, said driving voltage generating circuit is substantially unaffected by the reference voltage output by said reference voltage generating circuit.

17. A semiconductor integrated circuit device according to claim 1, wherein the input side of said driving voltage generating circuit is potentially in a state of high impedance, and wherein when the reference voltage is substantially unaffected by a variation in impedance in the input side of said driving voltage generating circuit.

18. A semiconductor integrated circuit device according to claim 1, wherein the contrast of the liquid-crystal display panel is controlled via said semiconductor integrated circuit without providing an external control device.

19. A semiconductor integrated circuit device connected to a power supply providing a power-supply voltage and provided with a circuit for driving a liquid-crystal display panel on the basis of a control signal output from a CPU via an address bus and a data bus, comprising:

a liquid-crystal control circuit for generating a driving signal for driving the liquid-crystal display panel;

a driving voltage generating circuit connected to said liquid-crystal control circuit, receiving a reference voltage and generating a voltage for driving said liquid-crystal control circuit responsive to the reference signal; and a reference voltage generating circuit connected to said driving voltage generating circuit for transforming the power-supply voltage responsive to the control signal received from said CPU into the reference voltage and for transmitting the reference voltage to said driving voltage generating circuit, wherein said reference voltage driving circuit comprises brightness level circuits, each of said brightness level circuits including a transmission gate receiving the control signal from the CPU, the control signal including data signals to control illumination of the liquid crystal display panel via the data bus and a write signal and an address signal via the address bus;

an inverter group connected to said transmission gate;

a transistor connected to said inverter group, and said inverter group being disposed between said transistor and said transmission gate, wherein the write signal controls activation of said transistor and transmission of the data signals, and the write signal and the data signals which are input to said transmission gate by the write signal control the reference voltage output from said reference voltage generating circuit; and a resistance connected in parallel with said transistor.

20. A semiconductor integrated circuit device according to claim 19, wherein said inverter group comprises a first inverter with a first inverter input and output, and a second inverter with a second inverter input and output, and wherein said first inverter output is connected to said second inverter input and said first inverter input is connected to said second inverter output.

21. A semiconductor integrated circuit device according to claim 20, wherein the first inverter has a large driving capacity, and the second inverter has a small driving capacity.

22. A semiconductor integrated circuit device according to claim 19, wherein said transistor and said resister of each of the brightness level circuits are connected together in series.

23. A semiconductor integrated circuit device according to claim 19, further comprising a terminal for outputting to the outside an output of said reference voltage generating circuit to be used to control external circuits and the contrast of a display associated therewith as well as to control internal circuits and the contrast of the liquid-crystal display panel associated therewith.

24. A semiconductor integrated circuit device according to claim 19, wherein the output side of said reference voltage generating circuit is potentially in a state of high impedance, and wherein when the reference voltage supplied to said driving voltage generating circuit is from outside said semiconductor integrated circuit, said driving voltage generating circuit is substantially unaffected by the reference voltage output by said reference voltage generating circuit.

25. A semiconductor integrated circuit device according to claim 19, wherein the input side of said driving voltage generating circuit is potentially in a state of high impedance, and wherein when the reference voltage is substantially unaffected by a variation in impedance in the input side of said driving voltage generating circuit.

26. A semiconductor integrated circuit device according to claim 19, wherein the contrast of the liquid-crystal display panel is controlled via said semiconductor integrated circuit without providing an external control device.

27. A semiconductor integrated circuit device connected to a power supply providing a power-supply voltage and provided with a circuit for driving a liquid-crystal display panel on the basis of a control signal output from a CPU via an address bus and a data bus, comprising:

a liquid-crystal control circuit for generating a driving signal for driving the liquid-crystal display panel;

a driving voltage generating circuit connected to said liquid-crystal control circuit, receiving a reference voltage and generating a voltage for driving said liquid-crystal control circuit responsive to the reference signal; and a reference voltage generating circuit connected to said driving voltage generating circuit for transforming the power-supply voltage responsive to the control signal received from said CPU into the reference voltage and for transmitting the reference voltage to said driving voltage generating circuit, wherein said reference voltage driving circuit comprises brightness level circuits, each of said brightness level circuits including register means for storing a voltage specifying signal N (0 to 15 in decimal code), said voltage specifying signal specifying that the reference voltage is represented as $Vcc * 16/(N+16)$, Vcc being power supply voltage providing sixteen levels of contrast, receiving the control signal from the CPU, the control signal including data signals to control illumination of the liquid crystal display panel via the data bus and a write signal and an address signal via the address bus;

switching means for receiving the voltage specifying signal from said register means and switching the voltage specifying signal to one of the power supply voltage and ground, wherein the write signal controls activation of said switching means and transmission of the data signals, and the write signal and the data signals which are input to said register control the reference voltage output from said reference voltage generating circuit;

resistance means for receiving the one of the power supply voltage and ground from said switching means and for outputting a resistance voltage responsive thereto; and operational amplifier means for receiving the resistance voltage from said resistance means and for outputting and output voltage to a display driving circuit as the reference voltage.

28. A semiconductor integrated circuit device according to claim 27, wherein said resistance means comprises resistance ladder means including first and second resistances, the first resistances connected in series and each of the second resistances connected between and in parallel with the first resistances and said transistor forming a ladder shape.

29. A semiconductor integrated circuit device according to claim 28, wherein the first resistances comprise a first resistance value R and the second resistances comprise a second resistance value 2R forming an R-2R resistance ladder.

30. A semiconductor integrated circuit device connected to a power supply providing a power-supply voltage and provided with a circuit for driving a liquid-crystal display panel on the basis of a control signal output from a CPU via an address bus and a data bus, comprising:

a liquid-crystal control circuit for generating a driving signal for driving the liquid-crystal display panel;

a driving voltage generating circuit connected to said liquid-crystal control circuit, receiving a reference voltage and generating a voltage for driving said liquid-crystal control circuit responsive to the reference voltage; and a reference voltage generating circuit connected to said driving voltage generating circuit for transforming the power-supply voltage responsive to the control signal received from said CPU into the reference voltage and for transmitting the reference voltage to said driving voltage generating circuit, wherein said reference voltage driving circuit comprises brightness level circuits, each of said brightness level circuits including register means for storing a voltage specifying signal N (0 to 15 in decimal code), said voltage specifying signal specifying that the reference voltage is represented as Vcc * 16/(N+16), Vcc being power supply voltage providing sixteen levels of contrast, receiving the control signal from the CPU, the control signal including data signals to control illumination of the liquid crystal display panel via the data bus and a write signal and an address signal via the address bus;

switching means for receiving the voltage specifying signal from said register means and switching the voltage specifying signal to one of the power supply voltage and ground, wherein the write signal controls activation of said switching means and transmission of the data signals, and the write signal and the data signals control the reference voltage output from said reference voltage generating circuit;

resistance means for receiving the one of the power supply voltage and ground from said switching means and for outputting a resistance voltage responsive thereto.

31. A semiconductor integrated circuit device according to claim 30, wherein said resistance means comprises four resistances connected in series having respective resistance values of 5R/2, 5R/4, 5R/8, and 5R/16.

32. A semiconductor integrated circuit device according to claim 30, wherein said transistor means for each of said brightness level circuits includes a P-channel MOS transistor.

* * * * *